United States Patent [19]

Arkans

[11] 4,156,425

[45] May 29, 1979

[54] PROTECTIVE COMPRESSION SLEEVE

[75] Inventor: Edward J. Arkans, Schaumburg, Ill.

[73] Assignee: The Kendall Company, Boston, Mass.

[21] Appl. No.: 823,362

[22] Filed: Aug. 10, 1977

[51] Int. Cl.[2] ..... A61H 1/00

[52] U.S. Cl. ..... 128/24 R; 128/171; 128/DIG. 15

[58] Field of Search .... 128/24 R, DIG. 15, DIG. 20, 128/82.1, 89 R, 38–40, 24.1, 64, 171

[56] References Cited

U.S. PATENT DOCUMENTS

| | | | |
|---|---|---|---|
| 3,391,692 | 7/1968 | Spielberg | 128/24 R |
| 3,442,270 | 5/1969 | Steinman | 128/DIG. 15 |
| 3,659,593 | 5/1972 | Vail | 128/DIG. 15 |
| 3,701,349 | 10/1972 | Larson | 128/82.1 |
| 3,856,008 | 12/1974 | Fowler et al. | 128/DIG. 15 |
| 3,901,225 | 8/1975 | Sconce | 128/DIG. 15 |
| 3,920,006 | 11/1975 | Lapidus | 128/82.1 |
| 3,933,150 | 1/1976 | Kaplan et al. | 128/24 R |
| 4,013,069 | 3/1977 | Hasty | 128/24 R |
| 4,081,150 | 3/1978 | Tyson | 128/DIG. 15 |

FOREIGN PATENT DOCUMENTS

| | | | |
|---|---|---|---|
| 498004 | 3/1976 | U.S.S.R. | 128/64 |

*Primary Examiner*—Lawrence W. Trapp

[57] ABSTRACT

A protective compression sleeve for applying compressive pressures against a patient's limb from a source of pressurized fluid. The sleeve has first and second surfaces, a pair of end edges, a pair of side edges connecting the end edges, and at least one fluid pressure chamber. The sleeve has a fastening device having a first fastening strip on one of the surfaces extending substantially the length of the sleeve adjacent one of the side edges, and a plurality of second fastening strips on the other of the surfaces and extending laterally along the sleeve toward the other side edge, with the second strips being located at spaced intervals substantially the length of the sleeve. The first and second fastening strips releasably engage to secure the sleeve about the patient's limb and release at a predetermined pressure in the chamber to prevent application of excessive pressures against the patient's limb.

8 Claims, 5 Drawing Figures

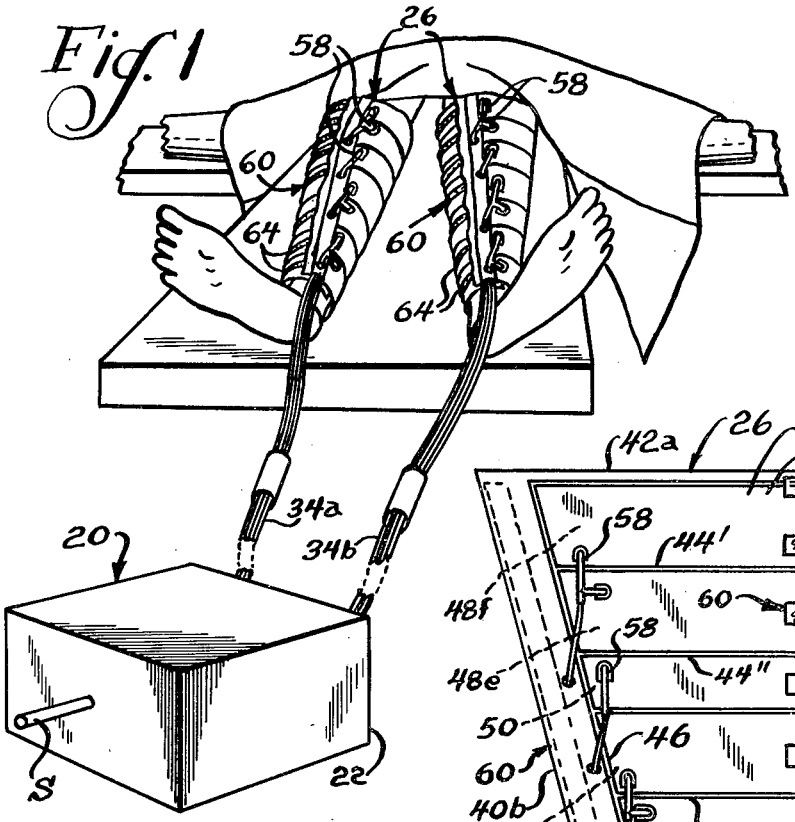
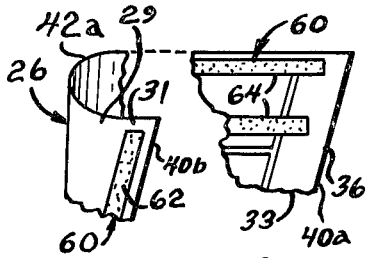
Fig. 5
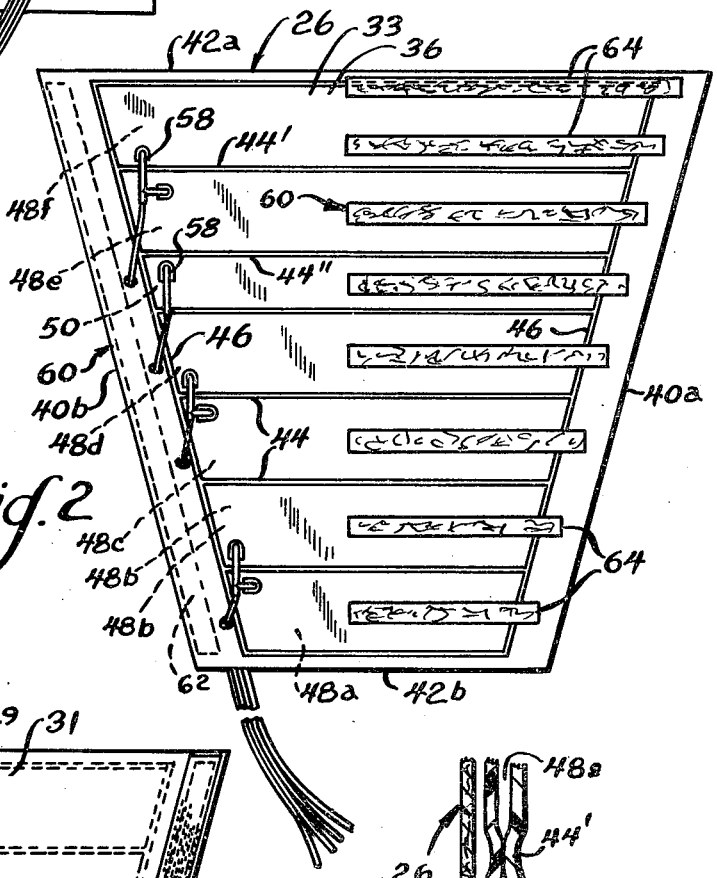
Fig. 2
Fig. 3
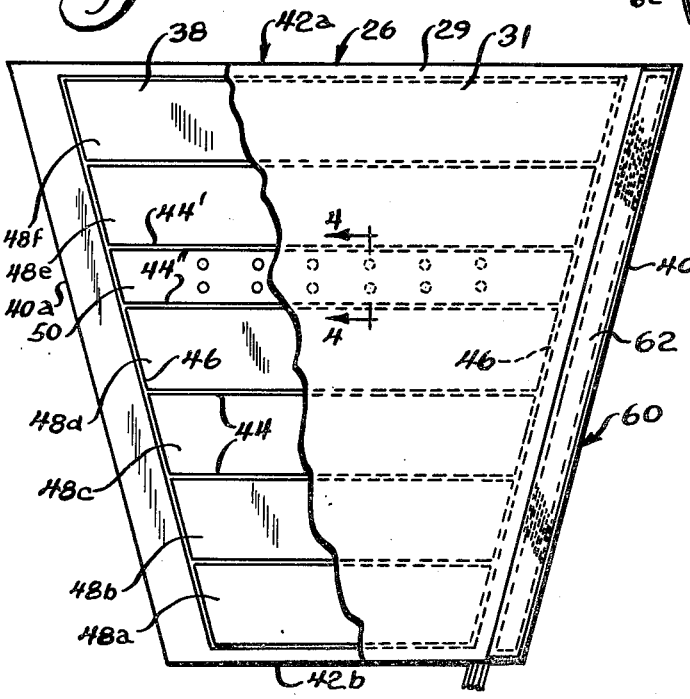
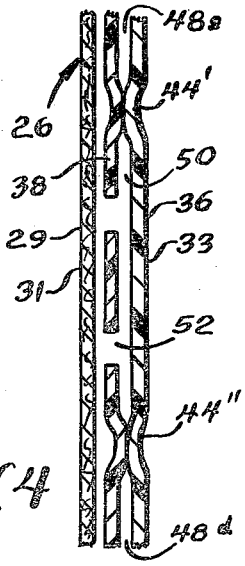
Fig. 4

PROTECTIVE COMPRESSION SLEEVE

BACKGROUND OF THE INVENTION

The present invention relates to therapeutic and prophylactic devices, and more particularly to sleeves for applying compressive pressures against the patient's limb.

It is known that the velocity of blood flow in a patient's extremities, particularly the legs, markedly decreases during confinement of the patient. Such pooling or stasis of blood is particularly pronounced during surgery, immediately after surgery, and when the patient has been confined to bed for extended periods of time. It is also known that stasis of blood is a significant cause leading to the formation of thrombi in the patient's extremities, which may have a severe deleterious effect on the patient, including death. Additionally, in certain patients it is desirable to move fluid out of interstitial spaces in extremity tissues, in order to reduce swelling associated with edema in the extremities.

Devices have been proposed for use in increasing the velocity of blood flow through the patient's limbs and minimizing edema, such as the devices disclosed in U.S. Pat. Nos. 4,013,069 and 4,030,488, and copending application Ser. No. 749,494, filed Dec. 10, 1976 now U.S. Pat. No. 4,091,804, incorporated herein by reference. These devices comprise a compression sleeve and a controller for sequentially inflating and deflating pressure chambers in the sleeve. It is desirable that the sleeves may be readily adjusted to the size of the particular patient in order to permit use of the sleeve on patients of varying leg sizes and to facilitate application of the sleeve about the patient's limb. In addition, it is desired to prevent the application of excessive pressures against the patient's limb which could impede the flow of blood through the limb.

SUMMARY OF THE INVENTION

A principal feature of the present invention is the provision of an improved device for applying compressive pressures against a patient's limb.

The device comprises an elongated pressure sleeve for enclosing a length of the patient's limb. The sleeve has first and second surfaces, a pair of end edges, a pair of side edges connecting the end edges, and fluid pressure chamber means. The sleeve has fastening means for securing the sleeve about the patient's limb comprising, a first fastening strip on one of the surfaces extending substantially the length of the sleeve adjacent one of the side edges, and a plurality of second fastening strips on the other of the surfaces and extending laterally along the sleeve toward the other side edge, with the second strips being located at spaced intervals substantially the length of the sleeve. The device has means for intermittently inflating and deflating the pressure chamber means.

A feature of the present invention is that the first and second fastening strips are releasably engagable to secure the sleeve about the patient's limb.

Another feature of the invention is that the longitudinal first strip and lateral second strips permit securement of the sleeve about the limb without the necessity of aligning fastening elements, and thus facilitate application of the sleeve about the limb in a simplified manner.

Yet another feature of the invention is that the sleeve may be readily adjusted to the size of the patient's limb, and may be utilized on patients with varying limb sizes.

Still another feature of the invention is that the fastening strips release at a predetermined pressure in the chamber means.

Thus, a feature of the invention is that the fastening strips prevent the application of excessive pressures against the patient's limb to minimize the possibility that the inflated sleeve may impede blood flow during use of the device.

Further features will become more fully apparent in the following description of the embodiments of this invention and from the appended claims.

DESCRIPTION OF THE DRAWINGS

In the drawings:

FIG. 1 is a fragmentary perspective view of a compression device having a pair of compression sleeves of the present invention;

FIG. 2 is a front plan view of the compression sleeve of FIG. 1;

FIG. 3 is a back plan view, partly broken away, of the sleeve of FIG. 2;

FIG. 4 is a sectional view taken substantially as indicated along the line 4—4 of FIG. 3; and FIG. 5 is a fragmentary view illustrating another form of fastening strips for the sleeve.

DESCRIPTION OF THE PREFERRED EMBODIMENTS

Referring now to FIG. 1, there is shown a compression device generally designated 20 for applying compressive pressures against a patient's extremities, such as the leg. The compression device 20 has a control apparatus 22, and a pair of compression sleeves 26 for enclosing lengths of the patient's legs.

As disclosed in U.S. Pat. Nos. 4,013,069 and 4,030,488 and copending application Ser. No. 749,494, the control apparatus 22 intermittently forms one or more fluid pressure pulses from a source S of pressurized gas during periodic compression or inflation cycles, and the pulses are separately applied to the sleeves 26 through two sets of conduits 34*a* and 34*b* which are separately connected to the sleeves. Also, the sleeves are intermittently deflated by the control apparatus 22 during periodic deflation or decompression cycles between the compression cycles.

As shown in FIGS. 2–4, the sleeves 26 have a pair of flexible outer and inner sheets 36 and 38, respectively, which are made from a fluid impervious material, such as polyvinyl chloride. The sheets 36 and 38 have a pair of side edges 40*a* and 40*b*, and a pair of end edges 42*a* and 42*b* connecting the side edges 40*a* and *b*. The sheets have a plurality of laterally extending lines 44, such as lines of sealing, and a pair of longitudinally extending lines 46, such as lines of sealing, connecting the sheets 36 and 38 together and connecting ends of the lateral lines 44, as shown. The connecting lines 44 and 46 define a plurality of pressure chambers 48*a*, 48*b*, 48*c*, 48*d*, 48*e*, and 48*f* which extend laterally between the sheets, and which are disposed longitudinally in the sleeve between the end edges 42*a* and 42*b*. When the sleeve is placed on the patient's leg, the lowermost chamber 48*a* is located on a lower part of the leg adjacent the patient's ankle, while the uppermost chamber 48*f* is located on an upper part of the leg adjacent the mid-thigh.

As shown, the sleeve 26 has a pair of lines 44' and 44'' defining a ventilation chamber or sizing portion 50 which extends between the adjoining pressure chambers 48*d* and 48*f*, such that the chamber 50 separates the pressure chambers into a set of lower contiguous chambers 48*a, b, c,* and *d,* and a set of upper contiguous chambers 48*e* and *f.* If desired, the inner sheet 38 may have a plurality of ventilation openings 52 extending through the sheet 38 and communicating with the chamber 50. Thus, air may be passed into the chamber 50 and through the openings 52 during use of the sleeve to ventilate the patient's limb, if desired. In addition, the chamber 50 has a sufficient length to permit movement of the sleeve between a first position with the adjoining chambers 48*d* and *e* being spaced apart a relatively small distance and a second position with the adjoining chambers 48*d* and *e* being spaced from each other a relatively large distance, such that the length of the sleeve 26 may be adjusted for the size of a limb on a particular patient.

As shown in FIGS. 3 and 4, the sleeve 26 has a sheet 29 of soft conformable material, such as a nonwoven material, overlying the outer surface of the inner sheet 38. Thus, the sheet 29 defines a first inner surface 31 which faces against the patient's limb after placement of the sleeve, while the outer sheet 36 defines a second outer surface 33 which faces away from the patient's limb after placement of the sleeve. Accordingly, the sleeve has a soft inner surface 31 which contacts the patient's limb for added comfort of the patient during use of the device.

In a preferred embodiment, the side edges 40*a* and 40*b* and the connecting lines 46 are tapered from the end edge 42*a* toward the end edge 42*b*. Thus, the sleeve 26 has a reduced configuration adjacent its lower end to facilitate placement of the sleeve on the more narrow region of the leg adjacent the patient's ankles. Moreover, it will be seen that the connecting lines 44 and 46 define chambers having volumes which may progressively increase in size from the lowermost pressure chamber 48*a* to the uppermost pressure chamber 48*f*. The relative size of the chambers facilitates the device to develop a compressive pressure gradient during the compression or inflation cycles which decreases from a lower part of the sleeve adjacent the end edge 42*b* toward an upper part of the sleeve adjacent the end edge 42*a*. As shown in FIG. 2, the sleeves 26 have a plurality of connectors 58 which are secured to the sheet 36 and which communicate with adjoining pairs of pressure chambers in the sleeves 26. As illustrated in FIG. 1, the connectors 58 are secured to the conduits 34*a* and *b,* such that the conduits separately communicate with pairs of adjoining pressure chambers in the sleeves through the connectors 58. As previously noted, the source of pressurized fluid may also be connected to the sizing portion or ventilation chamber 50 through a suitable connector, as shown.

As shown in FIGS. 2 and 3, the sleeves 26 have fastening means 60 for securing the sleeves 26 about the patient's limbs. The fastening means 60 comprises a first fastening strip 62 on the first sleeve surface 31 adjacent the side edge 40*b*. As shown, the first fastening strip 62 extends substantially the length of the sleeve 26 between the end edges 42*a* and *b*. The fastening means 60 also has a plurality of second fastening strips 64 on the second outer surface 33 of the sleeve 26. The second strips 64 extend laterally along the sleeve toward the side edge 40*a*, and the second strips 64 are located at spaced intervals substantially the length of the sleeve 26. In a preferred form, as shown, the second fastening strips 64 extend from a lateral central region of the sleeve to a location adjacent the side edge 40*a*, and a second fastening strip 64 may overlie each of the pressure chambers 48 in the sleeve 26.

In one form, the first and second fastening strips 62 and 64 may comprise hook and loop fastening elements, e.g., Velcro, a trademark of Velcro Corporation, New York, N.Y. Thus, the first fastening strip 62 may comprise a hook fastening element, while the second fastening strip 64 may comprise loop fastening elements, such that the fastening strips 62 and 64 releasably interengage with each other. In an alternative form, as shown in FIG. 5, the fastening strips 62 and 64 may comprise a cohesive-adhesive material, such as crepe and latex rubber.

With reference to FIG. 1, the sleeves 26 may be readily secured about the patient's limb by pressing the longitudinal first fastening strip 62 against the lateral second fastening strips 64. Thus, the fastening means of the present invention facilitates rapid and convenient securement of the sleeves about the patient's limb, since the fastening strips eliminate the need to bring fastening devices into precise alignment during the placement procedure. In addition, the fastening means permits adjustment of the sleeves about the patient's limbs, and allows the use of a single sleeve on various patients having differing leg sizes.

Since the attached strips 62 and 64 overlap in areas at their intersection, it will be seen that the total attachment surface area of the fastening strips is defined by the width of both fastening strips 62 and 64. Thus, the strength of attachment between the strips 62 and 64 is determined by the width of the fastening strips, and the attachment strength may be suitably controlled by selection of the fastening strip widths. In accordance with the present invention, the fastening strips are arranged to release at a predetermined pressure in the chambers 48 during the inflation cycles, such that the fastening means automatically release the sleeves if the predetermined chamber pressure should be inadvertently exceeded. In this manner, the fastening strips 62 and 64 prevent the application of excessive pressures against the patient's limb which otherwise might impede or stop the flow of blood through the patient's limb.

Once the sleeves 26 have been applied to the patient's limbs, the control apparatus 22 intermittently inflates the pressure chambers 48*a–f* in a manner producing a compressive pressure gradient which progressively decreases from a lower to an upper portion of the sleeve. After the compression cycles have been completed, the control apparatus 22 deflates the pressure chambers during periodic decompression cycles between the compression cycles, after which the control apparatus 22 repeats the compression cycles. As previously discussed, the fastening means 60 of the present invention automatically releases the sleeves 26 from the patient's limbs in the event that an excessive pressure should be developed in the sleeve chambers during the inflation cycles.

The foregoing detailed description is given for clearness of understanding only, and no unnecessary limitations should be understood therefrom, as modifications will be obvious to those skilled in the art.

I claim:

1. A device for applying compressive pressures against a patient's limb from a source of pressurized fluid, comprising:

an elongated pressure sleeve for enclosing a length of the patient's limb, said sleeve having first and second surfaces, a pair of end edges, a pair of side edges connecting the end edges, and fluid pressure chamber means, said sleeve having fastening means for securing the sleeve around the patient's limb comprising, a first fastening strip on one of said surfaces extending substantially the length of the sleeve adjacent one of said side edges, and a plurality of second fastening strips on the other of said surfaces and extending laterally along the sleeve toward the other side edge, said second strips being located at spaced intervals substantially the length of the sleeve, said first and second fastening strips being releasably engagable to secure the sleeve about the patient's limb and being of a particular and predetermined width enabling said strips to release at a predetermined pressure in the chamber means to prevent application of excessive pressures against the limb; and means for intermittently inflating and deflating said pressure chamber means.

2. The device of claim 1 wherein one of said first and second fastening strips comprises a hook fastening material, and the other of said first and second fastening strips comprises a loop fastening material.

3. The device of claim 1 wherein said one sleeve surface faces toward the patient's limb after placement of the sleeve.

4. The device of claim 1 wherein the second fastening strips extend from a lateral central region of the sleeve to a location adjacent said other side edge.

5. The device of claim 1 wherein the sleeve is tapered from one of said end edges toward the other end edge.

6. The device of claim 1 wherein said sleeve comprises a pair of fluid impervious sheets secured together along lines to define said chamber means, and a soft conformable sheet secured on one side of said fluid impervious sheets to define a surface for contacting the patient's limb.

7. The device of claim 1 wherein said sleeve has a plurality of laterally extending separate fluid pressure chambers progressively arranged longitudinally along the sleeve from a lower portion of the limb to an upper portion of the limb proximal to the patient's heart relative said lower portion.

8. The device of claim 7 wherein a second fastening strip is located over each of said separate chambers.

* * * * *